US006662525B2

(12) United States Patent
Dharssi et al.

(10) Patent No.: US 6,662,525 B2
(45) Date of Patent: Dec. 16, 2003

(54) SYSTEM AND METHOD FOR INCLUDING INSERTS WITH GOODS DURING AUTOMATED PACKAGING

(75) Inventors: Fatehali T. Dharssi, Vancouver (CA); Dale Lee Klinefelter, Rogers, AK (US); Brian Marshall, Garfield, AK (US)

(73) Assignee: DSD Communications, Inc., Stamford, CT (US)

( * ) Notice: Subject to any disclaimer, the term of this patent is extended or adjusted under 35 U.S.C. 154(b) by 35 days.

(21) Appl. No.: 09/780,950

(22) Filed: Feb. 9, 2001

(65) Prior Publication Data

US 2002/0017079 A1 Feb. 14, 2002

Related U.S. Application Data

(63) Continuation-in-part of application No. 09/632,900, filed on Aug. 7, 2000.

(51) Int. Cl.[7] ..... B65B 5/00
(52) U.S. Cl. ..... 53/238; 53/252
(58) Field of Search ..... 53/445, 447, 237, 53/238, 250, 251, 252; 271/99, 102

(56) References Cited

U.S. PATENT DOCUMENTS

| | | | | |
|---|---|---|---|---|
| 1,308,321 A | | 7/1919 | Armstrong | |
| 1,602,881 A | | 10/1926 | Christensen | |
| 1,683,789 A | | 9/1928 | Molins | |
| 1,721,552 A | | 7/1929 | Foernsler | |
| 1,805,119 A | | 5/1931 | Voigt | |
| 1,818,923 A | | 8/1931 | Taylor | |
| 1,913,642 A | | 6/1933 | Smith | |
| 2,072,516 A | | 3/1937 | Ferenci et al. | |
| 2,227,378 A | | 12/1940 | Milmoe et al. | |
| 2,294,273 A | * | 8/1942 | Buxbaum | 271/99 |
| 2,653,743 A | * | 9/1953 | Stenger | 53/250 |
| 2,741,886 A | | 4/1956 | Garapolo et al. | |
| 2,821,826 A | | 2/1958 | Stubblefield | |
| 3,797,822 A | * | 3/1974 | Anderson | 271/99 |
| 3,868,807 A | | 3/1975 | Noyes et al. | |
| 3,935,691 A | | 2/1976 | Broch | |
| 3,937,458 A | * | 2/1976 | Langen | 271/99 |
| 3,952,478 A | | 4/1976 | Richards et al. | |
| 4,182,222 A | | 1/1980 | Stahl | |
| 4,248,032 A | | 2/1981 | Woods et al. | |
| 4,268,344 A | | 5/1981 | Jones | |
| 4,297,826 A | | 11/1981 | Woertche | |
| 4,355,967 A | | 10/1982 | Hellmer | |
| 4,418,906 A | * | 12/1983 | Scott | 271/99 |
| 4,530,200 A | | 7/1985 | Prewer | |

(List continued on next page.)

FOREIGN PATENT DOCUMENTS

| | | |
|---|---|---|
| DE | 1761426 | 6/1971 |
| FR | 2332935 | 6/1977 |

*Primary Examiner*—John Sipos
*Assistant Examiner*—Louis Huynh
(74) *Attorney, Agent, or Firm*—Pillsbury Winthrop LLP

(57) ABSTRACT

The invention comprises an insert delivery system for use with an automated packaging machine. Preferably, the system is used to include coupons and the like with products being automatically packaged, such as sliced loaf bread. The system may comprise an insert delivery tray or card conveyor, a feeder mechanism, and an insert placer configured to select an insert from the tray or conveyor. Preferably, the delivery placer includes an arm having a holder which comprises a vacuum system. Additionally, the feeder mechanism may be used to feed an insert onto a scoop assembly at various points along the path of the scoop. In certain embodiments of the invention, the insert has multiple folds to allow it to be folded around the product prior to packaging. The invention also comprises methods of using the system.

9 Claims, 15 Drawing Sheets

U.S. PATENT DOCUMENTS

| | | | | | |
|---|---|---|---|---|---|
| 4,649,692 | A | | 3/1987 | Tomosue | |
| 4,658,564 | A | | 4/1987 | Bell, Jr. et al. | |
| 4,709,851 | A | | 12/1987 | Vanasse | |
| 4,815,251 | A | | 3/1989 | Goodman | |
| 4,833,861 | A | | 5/1989 | Hale et al. | |
| 4,837,956 | A | | 6/1989 | Dolence | |
| 4,908,761 | A | | 3/1990 | Tai | |
| 5,002,313 | A | | 3/1991 | Salvatore | |
| 5,079,901 | A | | 1/1992 | Kotsiopoulos | |
| 5,157,896 | A | * | 10/1992 | Tisma | 53/238 |
| 5,368,286 | A | | 11/1994 | Horsman et al. | |
| 5,477,662 | A | | 12/1995 | Rompa | |
| 5,481,094 | A | | 1/1996 | Suda | |
| 5,483,786 | A | | 1/1996 | Giesbrecht et al. | |
| 5,502,956 | A | | 4/1996 | Rompa | |
| 5,549,233 | A | | 8/1996 | Clauser | |
| 5,645,680 | A | | 7/1997 | Rietheimer | |
| 5,680,743 | A | | 10/1997 | Hoekzema | |
| 5,727,153 | A | | 3/1998 | Powell | |
| 5,737,899 | A | * | 4/1998 | Supron et al. | 53/238 |
| 5,806,044 | A | | 9/1998 | Powell | |
| 5,819,954 | A | | 10/1998 | Lacriola | |
| 5,826,356 | A | | 10/1998 | Lapp | |
| 5,941,053 | A | | 8/1999 | Kotsiopoulos | |
| 5,941,681 | A | * | 8/1999 | Piotrowski et al. | 271/99 |
| 6,035,605 | A | * | 3/2000 | Perego | 53/238 |
| 6,434,914 | B1 | * | 8/2002 | Bouldin et al. | 53/238 |
| 6,470,653 | B1 | * | 10/2002 | Lutz et al. | 53/238 |

* cited by examiner

SYSTEM AND METHOD FOR INCLUDING INSERTS WITH GOODS DURING AUTOMATED PACKAGING

RELATED APPLICATION DATA

This is a continuation-in-part of Ser. No. 09/632,900, filed on Aug. 7, 2000.

BACKGROUND OF THE INVENTION

1. Field of the Invention

The present invention relates to the field of automated packaging and specifically to the delivery of inserts to be automatically included with a product being packaged.

2. Description of Related Art

Automated bread packaging devices are widely used to wrap loaf bread in plastic. However, when packaging bread, it can be desirable to include coupons, promotional material, or other printed material directed at the purchaser of the bread. Prior-art systems for inserting this material into the package have generally been deficient. Coupons and the like can be added manually, after the bread has been placed in the wrapper and prior to closure, but this is labor intensive and time consuming. Similar problems characterize systems that place the coupons into the bag before wrapping the bread. Prior-art automated means for inserting a coupon into the bread package have required relatively complicated and expensive machinery and suffer from reliability problems. Further, these prior-art systems often require significant modification or even replacement of otherwise useful automated packaging machines.

Accordingly, what has been needed is an automated system for including inserts in packaged bread and other similar commodities. There is also a need for such an automated system that easily integrates with existing automated packaging machines. This invention satisfies these and other needs.

DETAILED DESCRIPTION OF THE INVENTION

Figure 1:
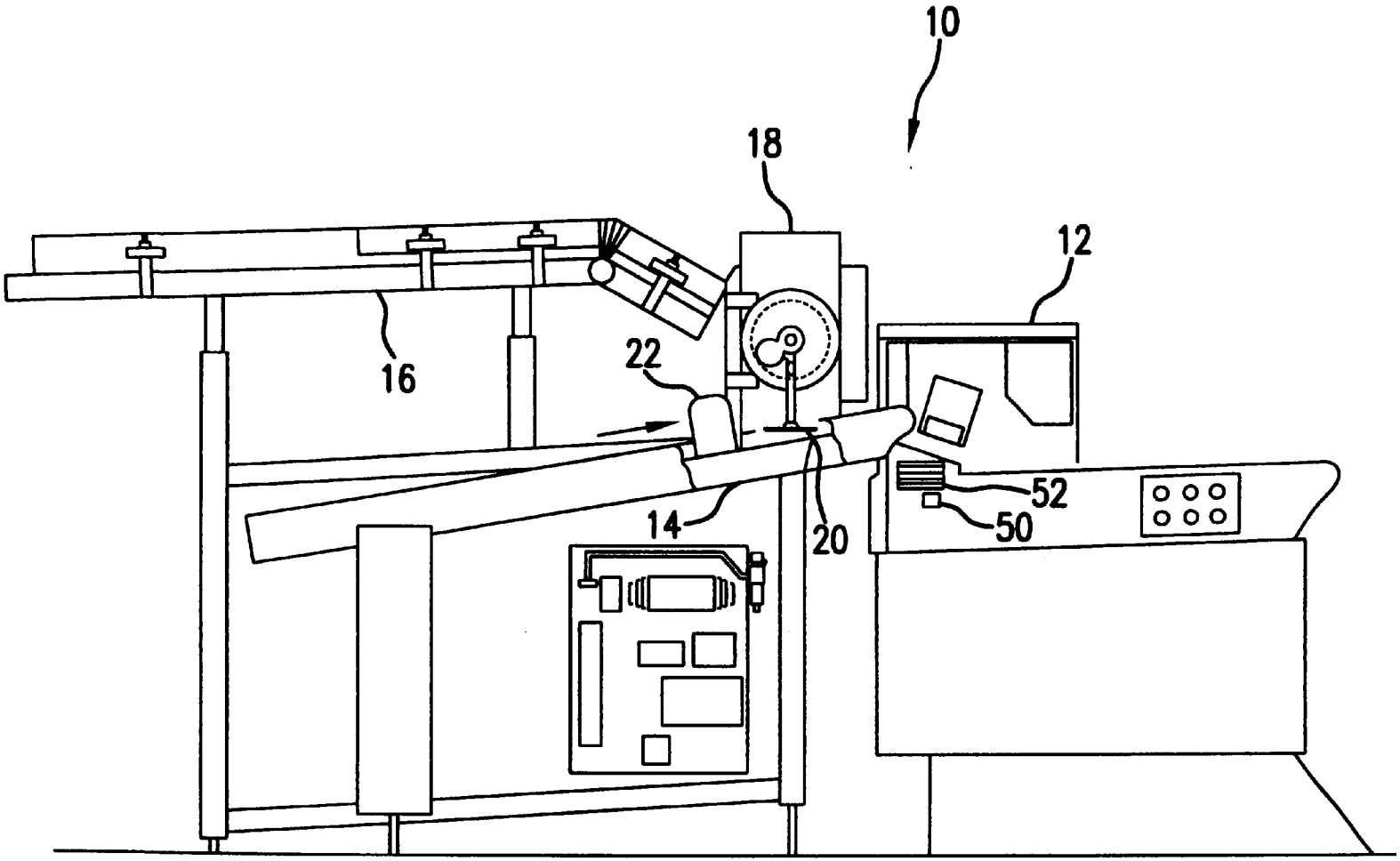
FIG. 1 is a schematic view of the insert delivery system of an embodiment of the invention in use with an automated bread packaging machine.

This invention is an insert delivery system for use with an automated product packager having an infeed to convey a product to be packaged. As is explained in further detail below, it is critical that the movement of the various components of the system be synchronized, such that each component can be positioned in the proper location at the appropriate time. In general, this is accomplished by: (1) placing sensors in critical locations within the components of the system, as well as on other devices that operate in conjunction with the system; (2) providing information gathered from the sensors as input into a programmable logic controller (PLC), or other similar device (e.g., a digital computer system with programmable memory); and (3) using the PLC or other similar device to activate the various components of the system at the appropriate time.

In one embodiment, the system comprises an insert delivery tray configured to present an insert to an insert placer, wherein the insert delivery system is configured so that the insert placer delivers the insert onto the infeed upstream of the product. The insert may be coupons, promotional material, or the like. The system is particularly suited to automatic packagers of the type used to wrap bread. In a preferred embodiment, the insert placer has an arm that cycles between an insert pick-up position and an insert drop-off position, with an insert holder that is adjacent the insert delivery tray and secures the insert when the arm is in the insert pick-up position and is adjacent the infeed and releases the insert when the arm is in the insert drop-off position. More preferably, the insert holder comprises a vacuum system.

In an alternative embodiment, the system comprises an insert delivery tray that is configured to present an insert to an insert placer. The insert placer, in turn, delivers the insert to a feeder mechanism (alternatively referred to as a "direct insert device") that is disposed adjacent, and above, a distal portion of an infeed conveyor. The infeed mechanism deposits the insert onto a scoop that has been advanced, or extended, towards a forward position, in order to receive the product (e.g., bread). In a preferred embodiment, the scoop has two sets of air apertures, wherein each set is preferably arranged in a line, and wherein at one selected time the air apertures provide a suction vacuum for securely retaining the insert that is placed on the scoop, and at a second selected time, the air apertures provide blow-off air, which helps separate the insert from the scoop before the scoop slides back to its retracted position.

In another embodiment, the system comprises an insert card conveyor that is configured to present an insert to an insert placer, wherein the insert placer delivers the insert to a feeder mechanism which, in turn, deposits the insert onto a fully-retracted scoop before the scoop receives the product, e.g., a loaf of bread. In a preferred embodiment, the scoop has two sets of air apertures, wherein each set is preferably arranged in a line, and wherein at one selected time the air apertures provide a suction vacuum for securely retaining the insert that is placed on the scoop, and at a second selected time the air apertures provide blow-off air, which helps separate the insert from the scoop before the scoop slides back to its retracted position, where it picks up another insert.

In yet another embodiment, the system comprises a scoop which has an additional lower compartment for carrying an insert. When in the fully-retracted position, an insert is deposited into the compartment, which is equipped with a means for driving the insert out from the distal end of the compartment once the scoop has been advanced (i.e., extended). Preferably, once the scoop has received a loaf of bread and extended into a wrapper, a plunger is used to push the insert into the wrapper, so that the insert will lie underneath the bread once the latter has been fully placed into the wrapper.

Certain embodiments of the invention further comprise a second delivery tray, or insert card conveyor, having a different insert, wherein the delivery trays or insert card conveyors are movable so that the insert placer can access either tray or conveyor depending upon which insert is desired. In other embodiments of the invention, the delivery tray or insert card conveyor is configured to accommodate a three-fold insert that wraps around the bottom and sides of the packaged item.

In yet other embodiments, the delivery tray, or insert card conveyor, may be a carousel and magazine assembly. Here, a rotating carousel is equipped with a plurality of vertical magazines, each of which holds a set of inserts. Each magazine is also equipped with sensors, so that, each time an insert in picked up by an insert placer device, a magazine insert advancement mechanism is activated to move the stack of inserts up in the vertical direction, so as to present the next insert to the insert placer device. When the inserts in one magazine are depleted, a sensor activates a servo motor, which in turn rotates the carousel in order to present the next magazine to the insert placer device. In addition, in this embodiment, the suction cups of the insert placer device move in two linear directions between a pick-up and a drop-off position.

The invention also includes methods of using an insert delivery system with an automated product packager. Generally, a method according to the invention comprises providing an automated product packager having an infeed and an insert delivery system having a first insert delivery tray configured to present a first insert to an insert placer, wherein the insert delivery system is configured so that the insert placer delivers the insert onto the infeed upstream of the product. The product is advanced along the infeed and an insert holder on the insert placer is operated to select and secure the insert from the delivery tray. The insert placer is then moved so that the holder is adjacent the infeed and the insert is released from the holder. This deposits the insert on the infeed upstream of the advancing product. The automated packager may then wrap the product and the insert.

Alternatively, a method for including inserts with goods during automated packaging includes providing an automated product packager (e.g., bread-bag packager) having an infeed and an insert delivery system having a first insert card conveyor configured to present a first insert to an insert placer, wherein the insert delivery system is configured so that the insert placer delivers the insert to a feeder mechanism. The feeder mechanism deposits the insert onto a bread scoop just before the scoop is advanced from its retracted position to receive the product (e.g., a loaf of bread) from the infeed conveyor. The loaded bread scoop is then advanced, receives the loaf of bread, deposits the loaf and the insert into a bag, and then retracts for another cycle. The automated packager may then wrap the product and the insert.

Alternatively, the feeder mechanism may be provided in a position above the scoop when the scoop is in its extended position, wherein the scoop receives the insert after it has been extended, but before it receives the loaf of bread.

Additionally, a method for including inserts with goods during automated packaging may include providing a scoop with an additional compartment underneath the scoop, depositing an insert in the compartment when the scoop is in the retracted position, advancing the scoop to receive the loaf of bread, advancing the distal ends of the scoop and compartment into a wrapper, and depositing first the insert, and then the bread, into the wrapper, before the scoop-and-compartment assembly is retracted.

FIG. 1 shows an automated bread packaging station 10 comprising a bread packaging machine 12, an infeed conveyor 14, an insert delivery tray 16 and an insert placer 18, configured to include an insert 20 with individual bread loaves 22 as they are wrapped. Bread packaging machine 12 generally is conventionally known in the art and its function in conjunction with the invention is described below (e.g., with reference to FIGS. 6–9). Infeed conveyor 14 is also similar to those in conventional use and utilizes a driven flight system to urge the individual loaves 22 along a smooth table, although other conventional means such as conveyor belts may also be used.

Figure 2A:
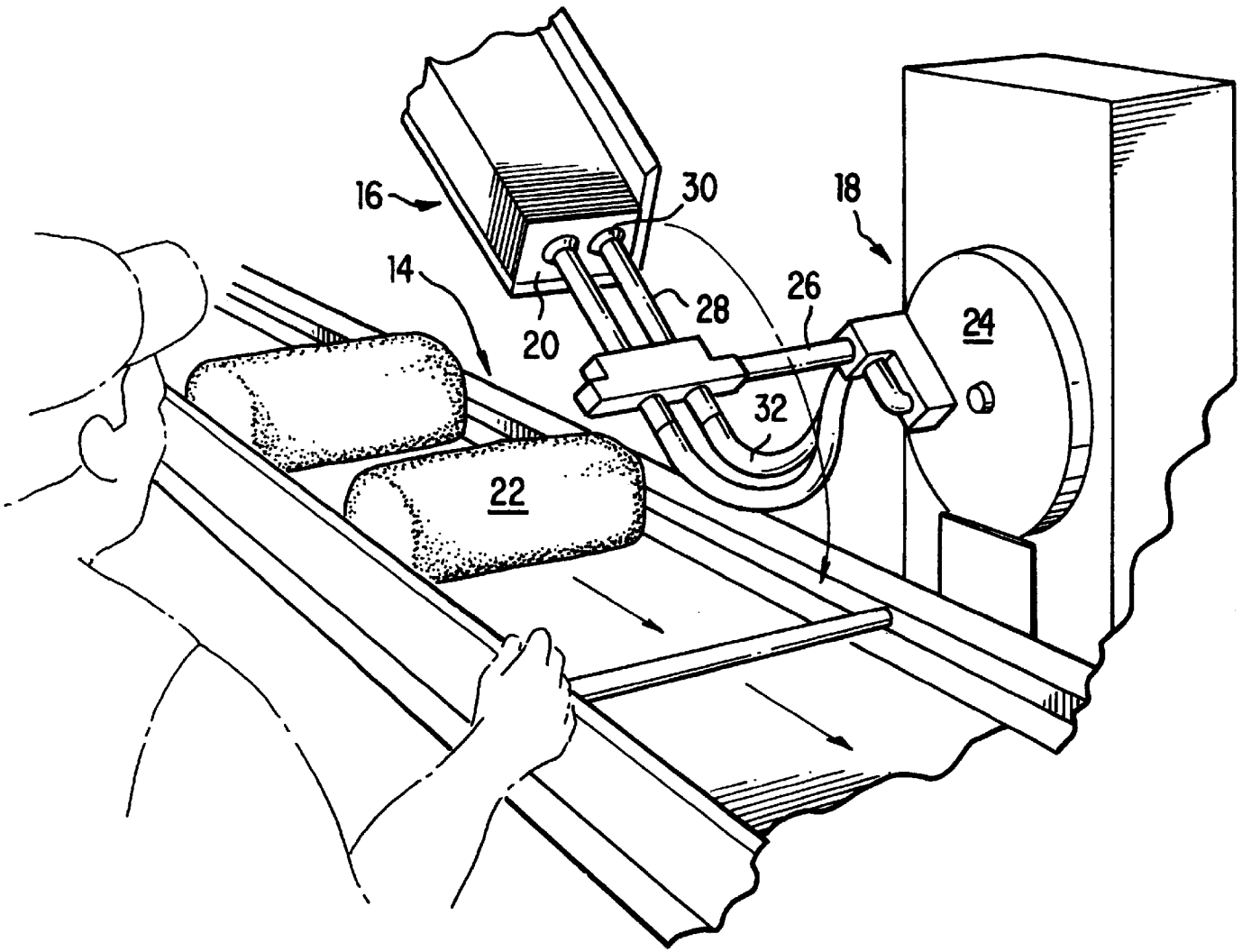
FIGS. 2A and 2B is a view of the insert delivery system of an embodiment of the invention oriented adjacent the infeed of the automated bread packaging machine.
Figure 2B:
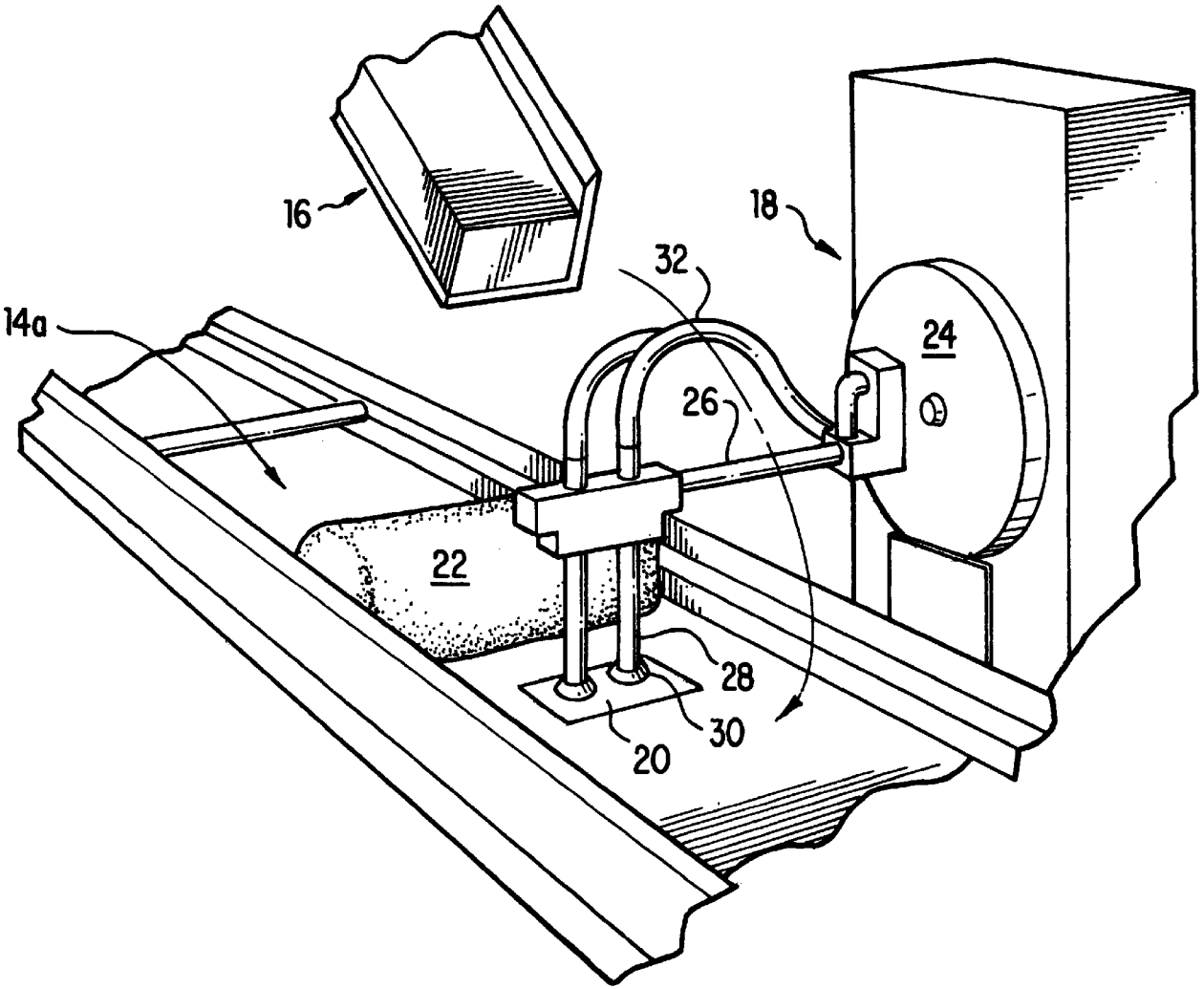

Insert placer 18 cycles between the two positions shown in FIGS. 2A and 2B to select an insert 20 from delivery tray 16 and then place it just upstream of the advancing loaf 22. In a preferred embodiment, insert placer 18 comprises rotating drive plate 24 having arm 26. Stems 28, each carrying a vacuum cup 30, are generally perpendicular to arm 26. The system is configured so that in the position shown in FIG. 2A, the vacuum cups are brought into contact with insert 20 which is accessible through the open end of delivery tray 16. The system applies a vacuum to cups 30 through hoses 32 and stems 28, thus securing insert 20 to the cups 30. Rotation of drive plate 24 swings the arm 26 and stems 28 to the insert drop-off position shown in FIG. 2B. The vacuum is released so that insert 20 remains on infeed conveyor 14 when insert delivery machine 18 swings back to the insert pick-up position of FIG. 2A. Insert 20 is carried by the advancing loaf 22 to packaging machine 12. Preferably, the insert placement motion is triggered by sensing the presence of a loaf 22 at the appropriate location on infeed conveyor 14 (e.g., via a sensor placed at position 14*a*, that, for illustrative purposes, may be about ¾ of the way along the conveyor 14 shown in FIG. 2B). The sensing may be accomplished by optical, mechanical, or any other suitable means.

In a preferred embodiment, insert delivery tray 16 is generally U-shaped and about six inches wide and three inches high. In this embodiment, a twelve-inch end portion of tray 16 adjacent insert placer 18 angles downward at about 30 degrees. In other embodiments, the dimensions of tray 16 generally should accommodate the size of insert 20, and the configuration of tray 16 may be adapted to insert placer 18, packaging machine 12, and infeed conveyor 14.

Figure 3:
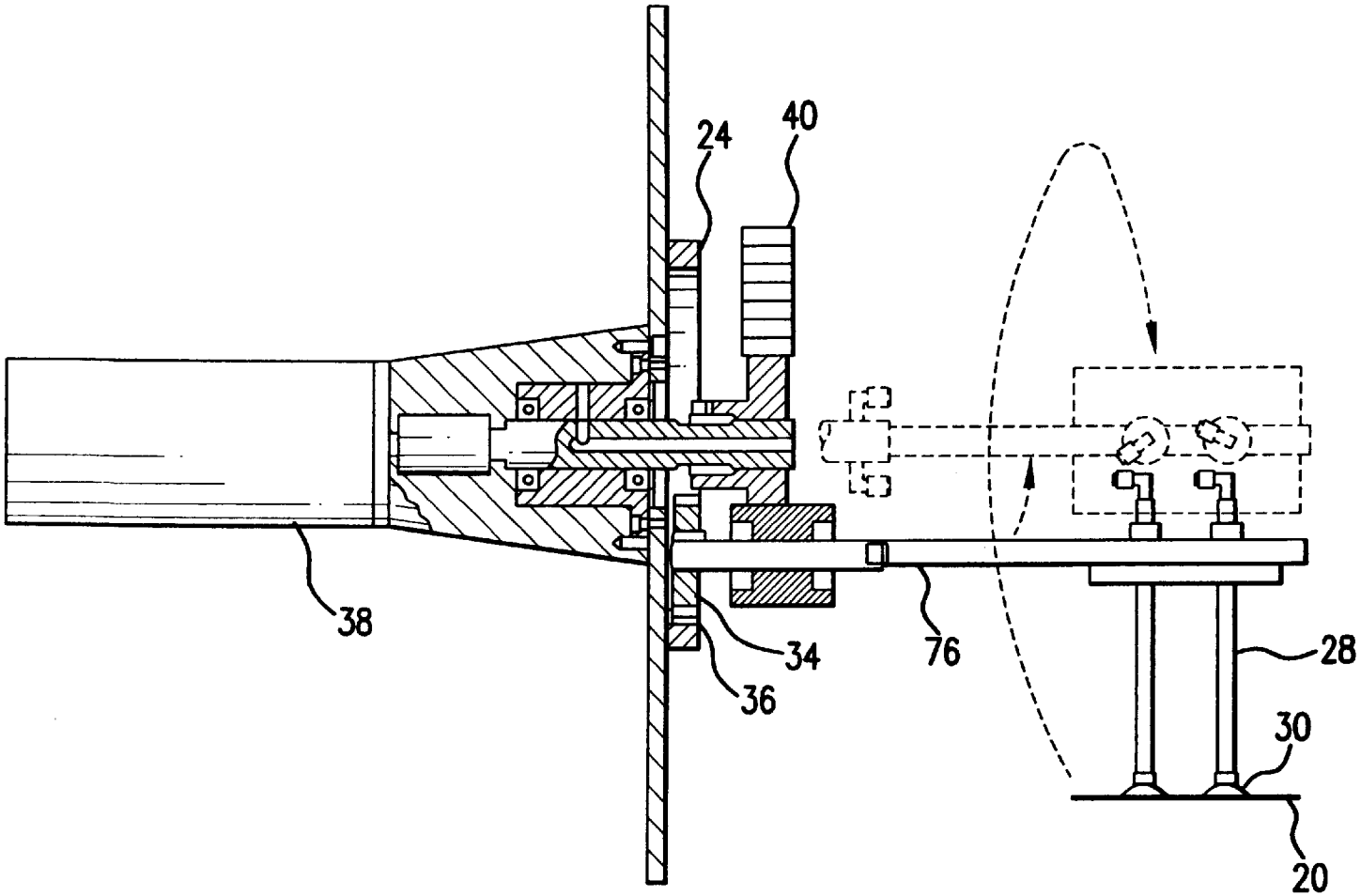
FIG. 3 is a detail top view of the insert delivery system of an embodiment of the invention.
Figure 4:
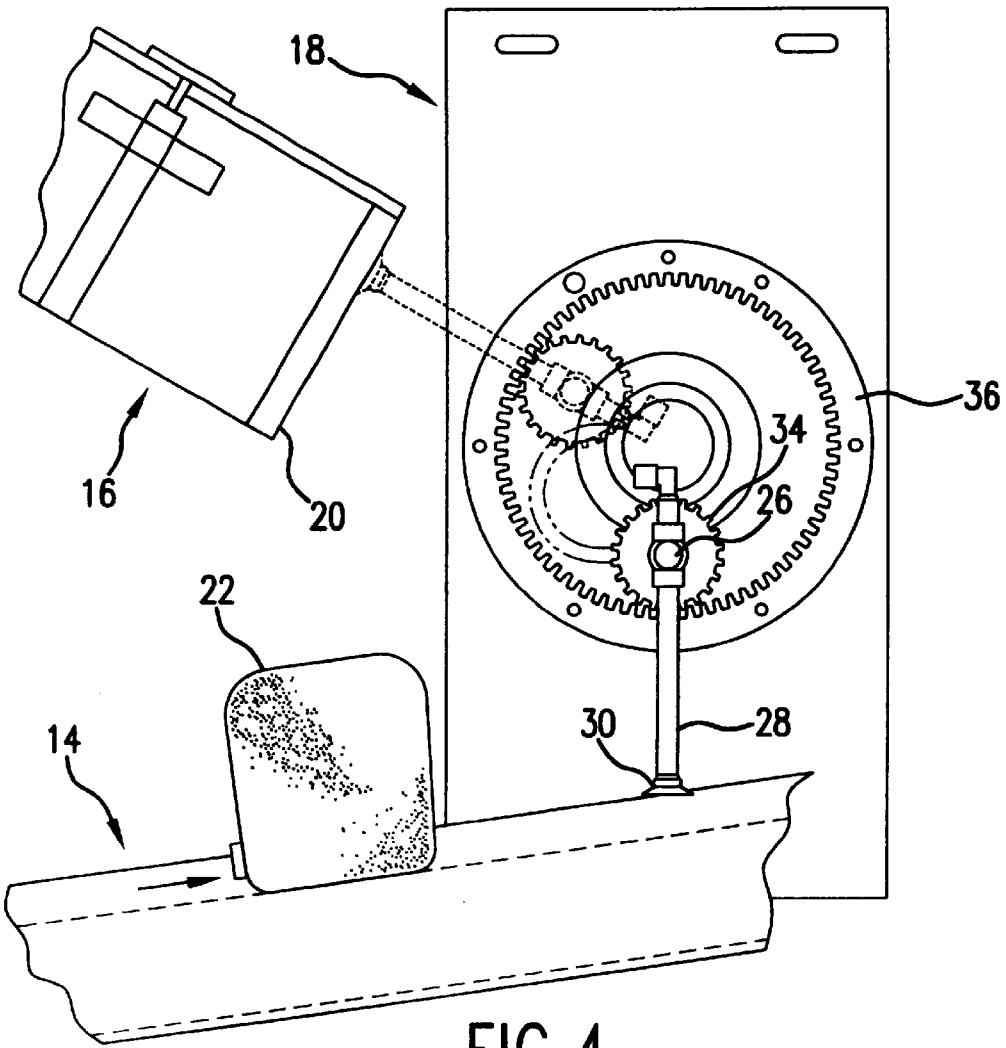
FIG. 4 is a detail side view of the insert delivery system of an embodiment of the invention.

FIGS. 3 and 4 show, partially in section, further details of the embodiment shown in FIGS. 2A and 2B. FIG. 3 is a top view showing the motion between the insert pick-up position and the drop-off position (shown in phantom). Ann 26 is driven by pinion gear 34 and ring gear 36 via servo motor 38. A counter weight 40 may be positioned opposite arm 26 to decrease the load on the servo. Similarly, FIG. 4 is a side view showing the motion between the drop-off position and the pick-up position (shown in phantom).

Other embodiments of the invention may employ different insert holding and delivery mechanisms. For example, the inserts may be presented by the delivery tray in an edgewise manner. In such embodiments, the insert holder generally comprises an articulated gripper as opposed to the vacuum cup arrangement. Also, one of skill in the art will easily recognize that delivery motions other than the rotation described herein may be used. Further, the insert delivery tray may be configured to simply release single inserts, allowing gravity to drop them into position ahead of the advancing loafs.

In yet other embodiments, the delivery tray may be replaced by a carousel and magazine assembly. Here, a rotating carousel is equipped with a plurality of (typically, between four and eight) vertical magazines, each of which holds a set of inserts which are placed horizontally in the magazine and stacked in a vertical arrangement. Each magazine is also equipped with sensors, so that, each time an insert in picked up by an insert placer device, a magazine insert advancement mechanism is activated to move the stack of inserts up in the vertical direction (via, e.g., a lead-screw-and-knot assembly, or an air-cylinder-and-brake assembly), so as to present the next insert to the insert placer device. When the inserts in one magazine are depleted, a sensor activates a servo motor, which in turn rotates the carousel in order to present the next magazine to the insert placer device.

One or more additional bar code readers can be mounted on the carousel and magazine assembly to determine whether the identity of the insert is proper for the particular type or brand of bread being wrapped.

The insert placer device comprises suction cups of the kind discussed above, except that, in this embodiment, the cups do not cycle by rotating between a pick-up and a drop-off position. Rather, the suction cup assembly of the placer device moves in two linear directions. Thus, as an insert is presented atop the stack of inserts in a magazine, suction cups move vertically downwards in a direction that is perpendicular to the plane of the insert, and secure the insert from above. Then, with the insert secured, the suction cup assembly moves in a direction that is parallel to the plane of the insert, and releases the insert in a drop-off position.

Figure 5:
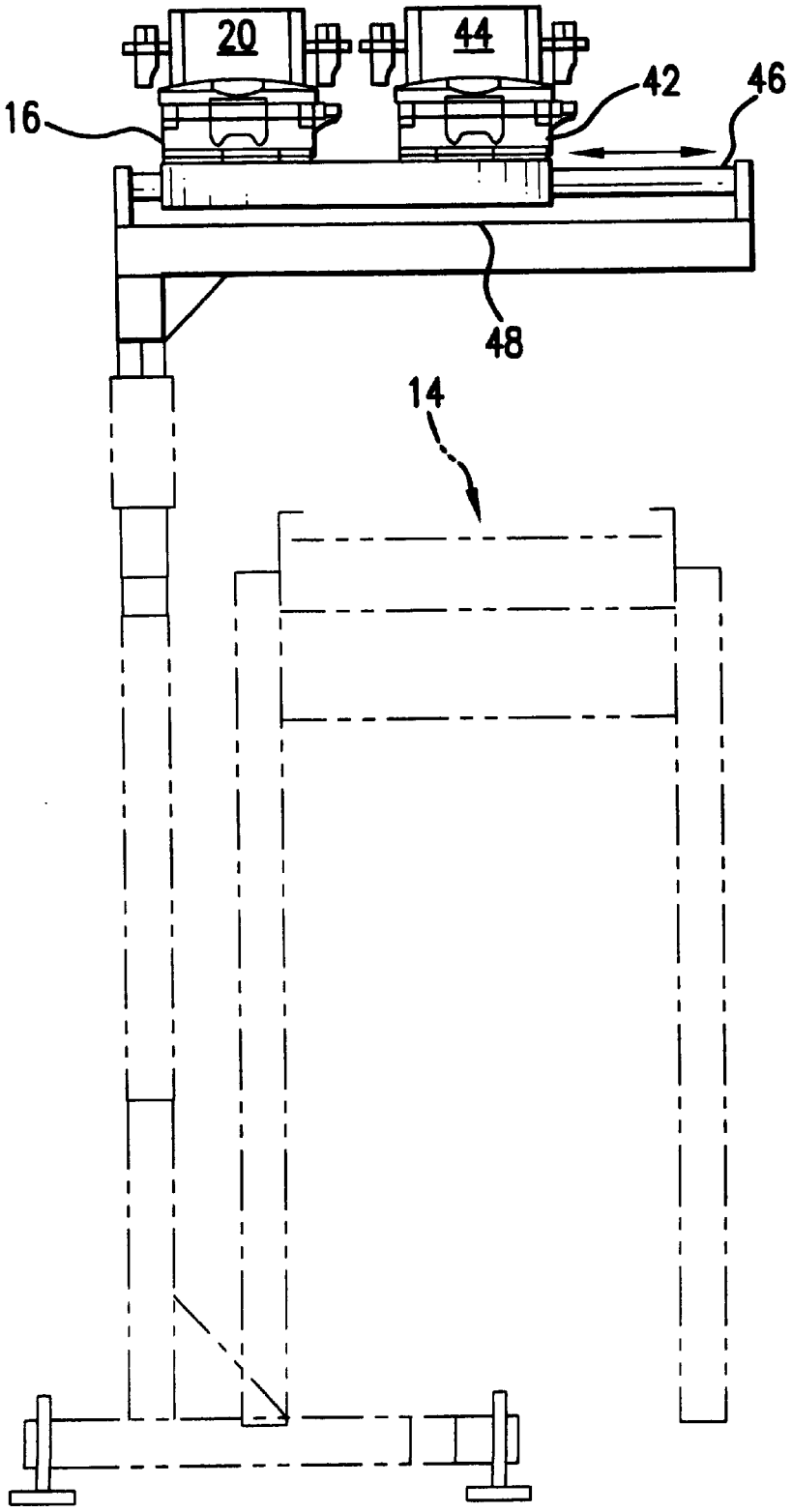
FIG. 5 shows an alternate embodiment of the invention comprising two insert delivery trays.

Returning to FIGS. 1, 2A, and 2B, insert delivery tray 16 preferably presents a stack of individual inserts 20 to delivery machine 18. The stack of inserts may be moved along tray 16 by any suitable mechanism, such as by a spring loaded system. One embodiment employs a conveyor belt to maximize the capacity of the system. Optionally, the invention comprises a plurality of delivery trays 16 and 42 as shown in FIG. 5, carrying inserts 20 and 44 respectively (insert placer 18 is not shown for clarity). Trays 16 and 42 slide along rail 46 so that either may be presented to delivery machine 18. In this embodiment, movement of the trays is actuated by hydraulic cylinder 48, although any other suitable mechanism may be employed. Preferably, tray 16 and tray 42 are spaced about 11 inches on center to accommodate a typical insert size of about 3 inches by 6 inches. These dimensions may be adjusted as desired.

In one embodiment of the invention, a sensor 50, such as a bar code reader to scan the UPC label of the wrappers 52, is provided on the packaging machine 12. The information from sensor 50 is used, in conjunction with a PLC, or other similar device, to control cylinder 48 to automate the selection of either inserts 20 or 44 depending upon the product being packaged as indicated by the wrappers 52. This allows the user of the information to tailor the inserts to the expected demographic of the buyer of the particular product, for example.

Figure 6:
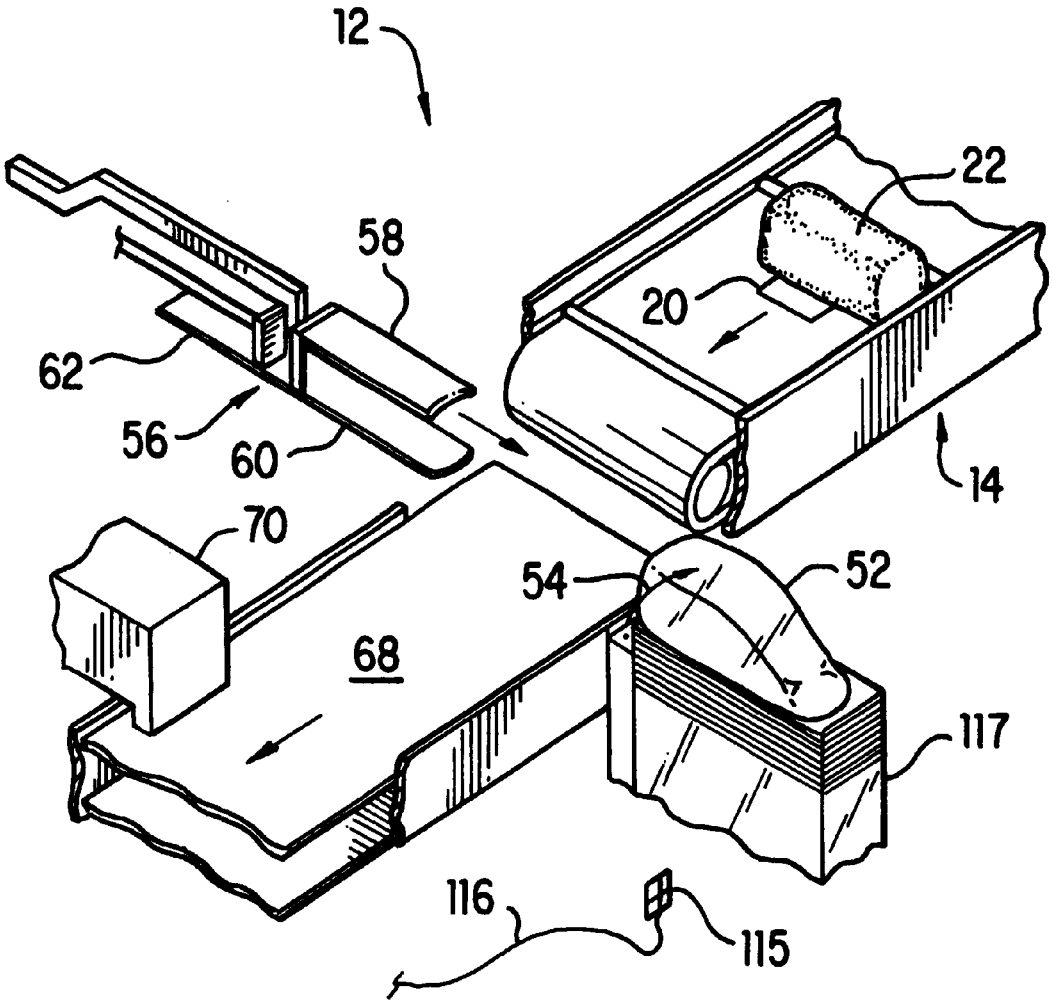
FIGS. 6–9 are schematic views of a bread packaging system suitable for use with embodiments of the invention, showing a loaf of bread and an insert being wrapped.
Figure 7:
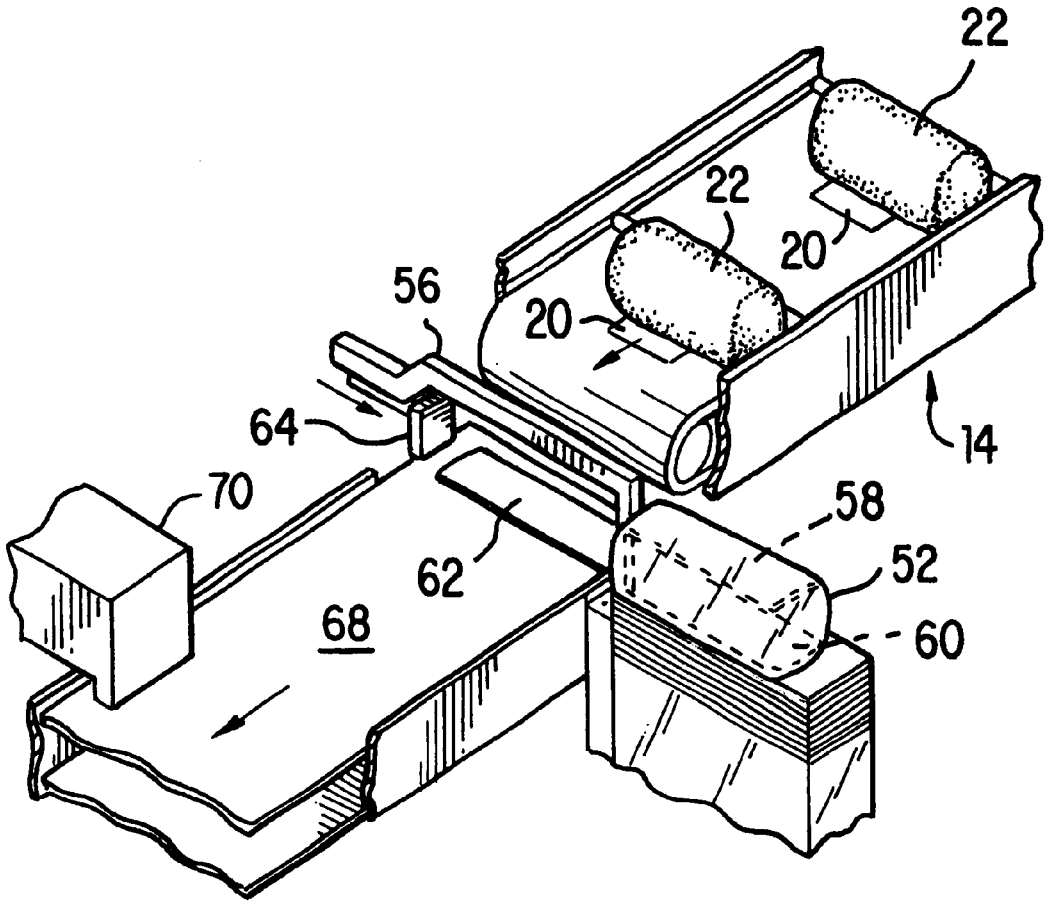
Figure 8:
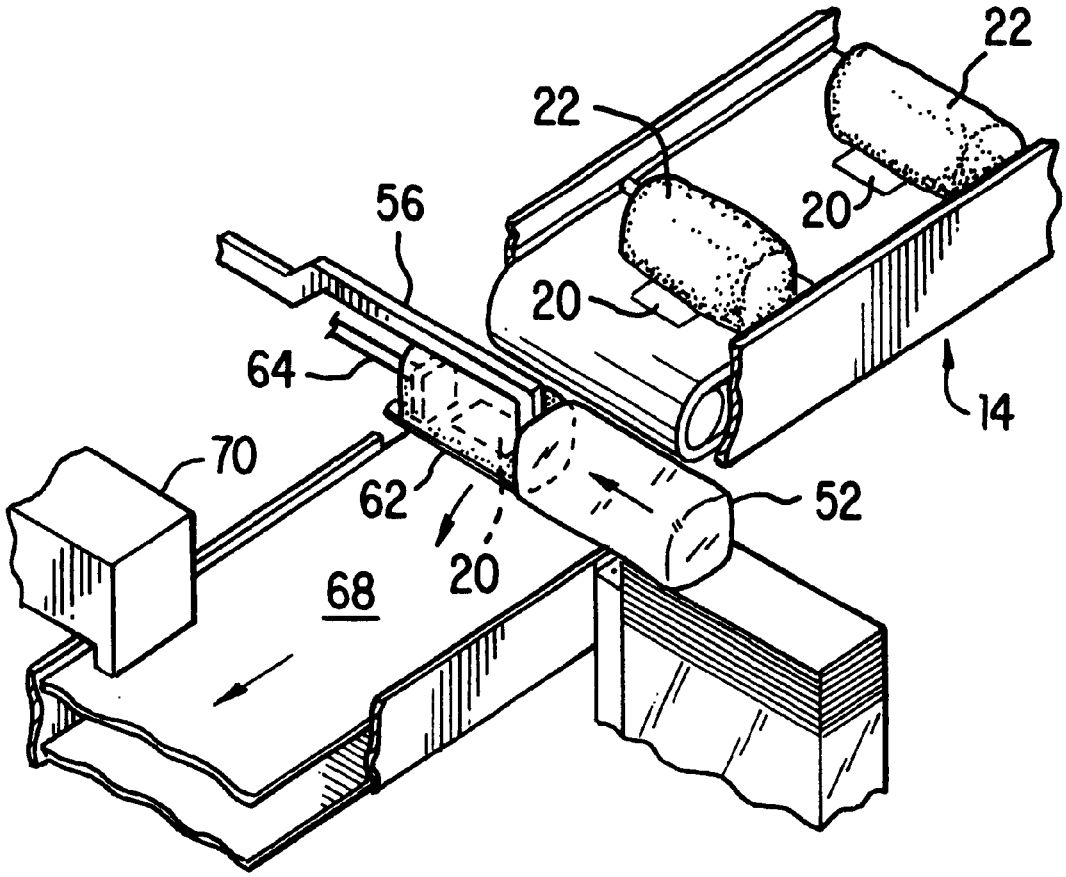
Figure 9:
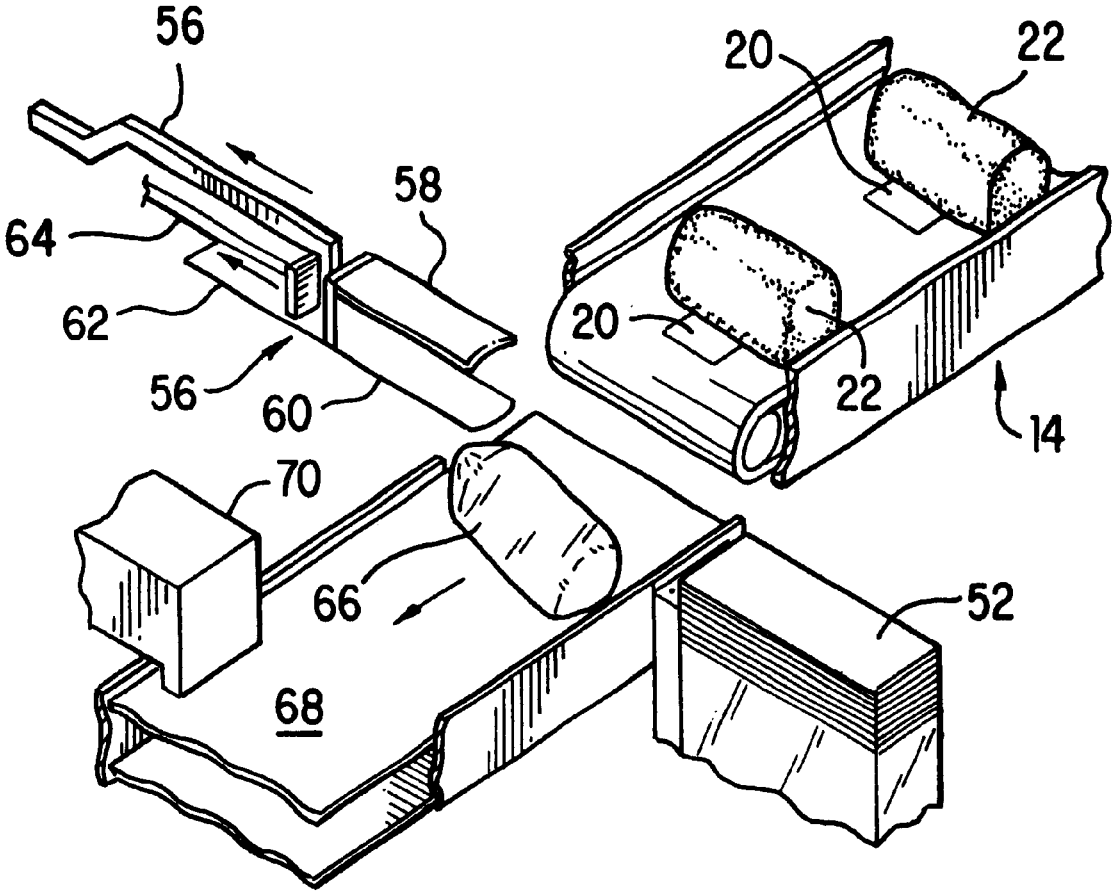

FIGS. 6–9 schematically show how packaging machine 12 wraps the loaves 22 and inserts 20 provided by delivery machine 18 and delivery tray 16. In FIG. 6, the advancing loaf 22 pushes insert 20 ahead of it. Wrapper 52 is opened, preferably with a jet of air 54, to receive scoop 56. Scoop 56 has upper and lower clamshell members 58 and 60, wherein lower member 60 further comprises a loaf receiving portion 62. As shown in FIG. 7, scoop 56 has advanced into opened wrapper 52 and members 58 and 60 have opened to grip wrapper 52 and secure it in an opened position. Loaf receiving portion 62 is positioned to catch insert 20 and then loaf 22 as they are delivered by infeed conveyor 14. A pushing assembly 64 has also advanced to a position adjacent the incoming loaf 22. FIG. 8 shows scoop 56 being withdrawn after insert 20 and loaf 22 have been deposited on receiving portion 62. Pushing assembly 64 is kept in its advanced position so that loaf 22 is retained in substantially the same spatial position while withdrawing scoop 56 pulls opened wrapper 52 over the loaf. Since the coefficient of friction of the bread loaf is considerably higher than that of the receiving portion, insert 20 stays with loaf 22 as it is wrapped. Scoop 56 completes its withdrawal and then pushing assembly 64 also withdraws, allowing wrapped loaf 66 to drop onto outfeed conveyor 68 where it will be carried to tying machine 70 for closure. The process is then repeated for the next loaf and insert on the infeed conveyor 14.

As further noted in reference to FIG. 6, embodiments of the present invention can also be configured to include a UPC bar code reader 115, positioned to read bar codes printed upon bags or wrappers 52 through transparent support surface 117. The information read by reader 115 can be conveyed via line 116 to the upstream insert placer 18 for proper insert selection.

Figure 11:
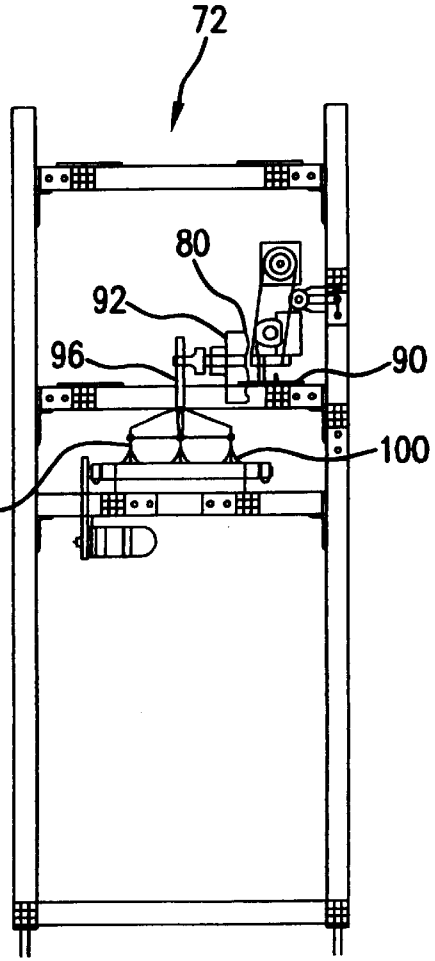
FIG. 11 is a front view of the embodiment of the invention shown in FIG. 10.
Figure 10:
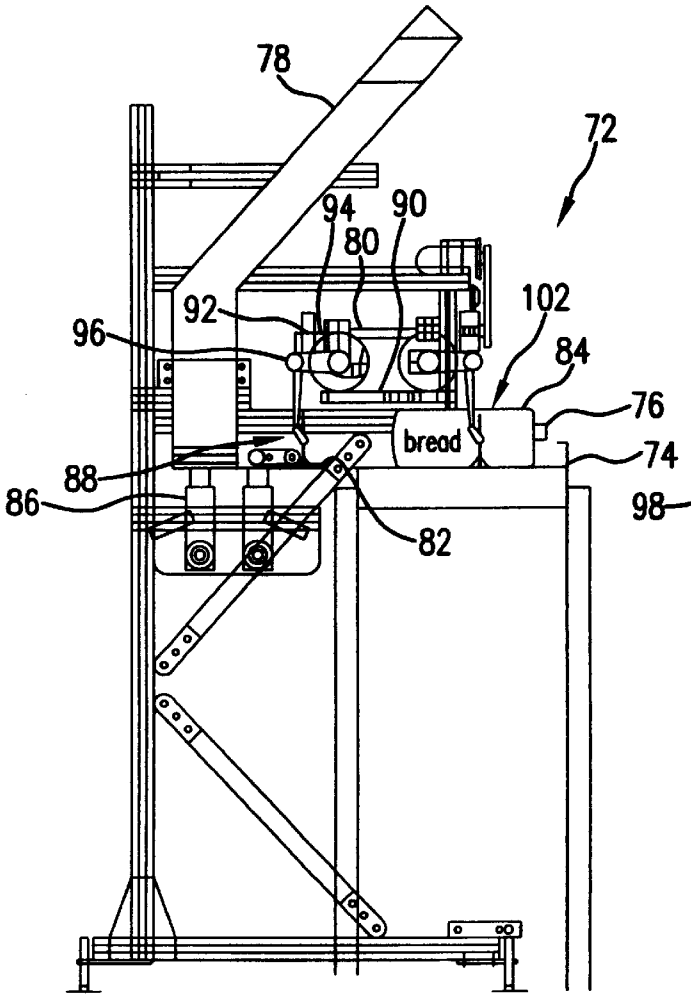
FIG. 10 is a schematic view of an embodiment of the invention configured to automatically package a three-fold insert.

FIGS. 10 and 11 show an alternate embodiment of the invention that is configured to automatically package a three-fold insert. Here, an automated bread packaging station 72 comprising a bread packaging machine 74, an infeed conveyor 76, an insert delivery tray 78, and an insert placer 80, configured to include a three-fold insert 82 with individual bread loaves 84 as they are wrapped. As described above, bread packaging machines are conventionally known in the art. The infeed conveyor 76 of packaging machine 74 conveys loaves of bread to the packaging machine, such as by a driven flight system to urge the individual loaves 84 along a smooth table. Insert placer 80 cycles between the solid position and the position shown in phantom. A servo 86 at the bottom of insert delivery tray 78 engages the bottommost insert 82 and urges it laterally to the insert pick-up position 88. In this embodiment, insert placer is driven laterally along rack 90 by pinion 92. Drive plate 94 has an arm 96 with stems 98, each ending in a vacuum cup 100. Selective operation of the vacuum cups allows the insert placer to pick up an insert and then drop it off as described above. As insert placer 80 moves laterally along rack 90, the drive plate rotates 180 degrees and arm 96 also rotates 180 degrees so that insert 82 is placed in drop-off position 102, immediately ahead of advancing loaf 84.

Figure 12:
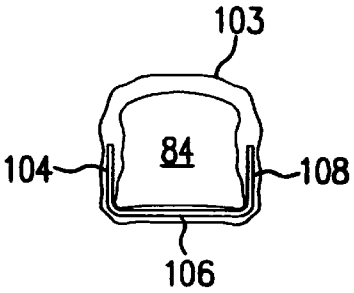
FIG. 12 is a schematic view of a three-fold insert of an embodiment of the invention around a packaged item.

As shown in FIG. 12, operation of this embodiment of the invention yields a loaf of bread 84, wrapped in a suitable package 103, with insert 82 folded around the loaf. Specifically, the first portion 104 of insert 82 is along one side of loaf 84, second portion 106 of the insert lies under the loaf, and third portion 108 of the insert is along the other side of the loaf. During packaging, the deposited three-fold insert 82 is driven forward along infeed conveyor 76 by advancing loaf 84. The bread packaging machine is substantially similar to the type described above. As the insert is pushed into the scoop, the first fold 104 is pushed up into a substantially vertical orientation. The loaf then falls onto second portion 106 and the third portion 108 is folded up allowing the clamshell to pull the wrapper over the loaf and suitably positioned insert. In some embodiments, it may be desirable to provide the scoop with a flange to help urge the third portion 108 of insert 82 into its vertical orientation.

One of skill in the art will recognize that this embodiment of the invention could easily be configured for a two-fold insert as well, so that one portion of the insert is along one side of the loaf and a second portion is underneath the loaf.

Figure 13:
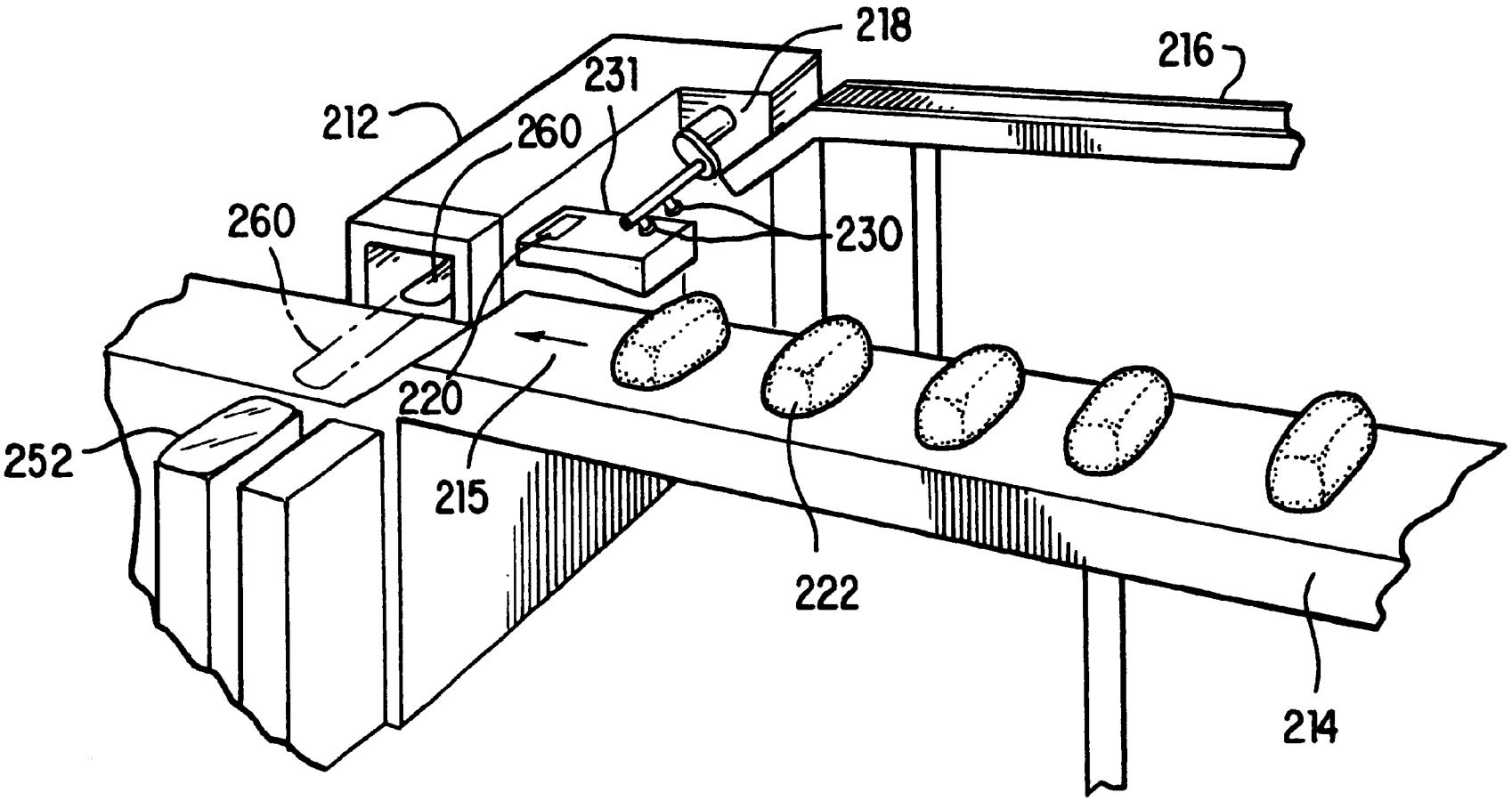
FIG. 13 is a schematic view of an alternative embodiment of the invention.

In the above embodiments, the proper alignment of the bread and insert relies upon certain frictional forces which exist as the bread and insert travel along the conveyor as they approach the bagger. FIG. 13 shows an alternative embodiment of the invention, wherein the inserts are deposited onto the bread scoop, which subsequently receives the loaf of bread, rather than having the insert deposited onto the infeed conveyor ahead of the bread.

More specifically, in this embodiment, the insert delivery system comprises an insert card conveyor 216, and an insert placer 218, which are similar, respectively, to the insert delivery tray 16 and insert placer 18 described previously. In a preferred embodiment, as each insert 220 advances along the insert card conveyor 216, vacuum cups 230 of the insert placer 218 engage and secure the insert 220 and place the insert onto a feeder mechanism 231.

In this embodiment, as in the embodiments described previously, the invention includes an infeed conveyor 214, which is similar in structure and operation to infeed conveyor 14, a packaging machine 212, which is similar to packaging machine 12, and a scoop assembly (not shown), including lower bread scoop 260. As shown in FIG. 13, the feeder mechanism 231 is adapted so as to be disposed adjacent, and above, a distal portion 215 of the infeed conveyor 214, as well as adjacent the lower bread scoop 260, when the latter is in the advanced, or extended, position. More specifically, the feeder mechanism 231, which is a timed advancement mechanism, is positioned such that, as the lower bread scoop 260 moves towards the advanced position, such as is shown in phantom in FIG. 13, the feeder mechanism 231 receives an insert 220 from the insert placer 218 and, at the appropriate time, feeds, or deposits, the insert 220 onto the lower bread scoop 260.

In a preferred embodiment, the timed deposition of the insert 220 via the feeder mechanism 231, as well as the loading of the loaf 222 unto the scoop 260, are accomplished by a series of sensors located throughout the system which provide logistic information as input data into a PLC, which, in turn, sends output signals activating the various components of the system. More specifically, in a preferred embodiment, the sensors are positioned so as to provide at least three separate pieces of data as input into the PLC.

First, the bread loaf conveyor and the scoop assembly run on a single chain cycle. As such, an encoder, interacting with the PLC, ensures that the respective speeds of the bread conveyor, on the one hand, and the scoop, on the other, are synchronized. Second, as has been mentioned before with reference to FIG. 2B, an optical (or similar) sensor is placed at a point that is preferably about ¾ of the way along the infeed conveyor. When a loaf of bread that is on the conveyor and on its way to be loaded unto the scoop passes this point, it covers the sensor, thus signaling to the PLC that the loaf is about to reach the vicinity of the scoop assembly. The PLC then sends a signal to the scoop assembly for the latter to begin advancing towards its extended position. The PLC also uses this information to activate the insert placer and feeder mechanism. Finally, the scoop assembly itself is equipped with one or more position sensors, which help fine-tune the position of the scoop so that it will receive the insert and the loaf at an appropriate time and at the proper position.

The feeder mechanism 231 typically comprises two sets of rollers. A first set of rollers, placed towards the back of the mechanism, receive the insert 220 from the insert placer 218. When an appropriate signal is received from the PLC, a servo motor is activated to rotate these rollers, thus advancing the insert to the front portion of the infeed mechanism 231. Then, based on information received from the sensor(s) on the scoop assembly, the PLC sends a second signal to a second servo motor, which, in turn, causes the second set of rollers to advance the insert and shoot it out onto the scoop 260.

Based on the above description, the timing of insert deposition by the feeder mechanism 231 on the one hand, and the timing of bread advancement by the feeder conveyor 214, on the other, are synchronized such that, for every loaf of bread 222 that moves along the conveyor, the feeder mechanism 231 loads the lower bread scoop 260 with an insert 220 prior to the arrival of the loaf. Thus, every time the lower bread scoop is advanced, it receives first an insert from the feeder mechanism 231, and then a loaf of bread 222, wherein the loaf rests on top of the insert.

More specifically, as a loaf of bread 222 is advanced on the infeed conveyor 214, a wrapper is 252 is opened as described previously (with respect to wrappers 52), and the scoop assembly, including the lower bread scoop 260, move into position to receive an insert 220 and a loaf 222. The scoop assembly then continues to advance until its forward portion is inside the wrapper 252. Once inside, the scoop assembly then reverses direction, thus pulling the wrapper 252 over the loaf 222, which then exits the scoop assembly. As the scoop assembly begins to move rearwardly, the insert 220 remains positioned under the loaf of bread 222 as the lower bread scoop 260 slides from underneath on its way back to the fully-retracted position (as shown, for example, in FIGS. 6–9, and the solid lines in FIG. 13).

Once the wrapper 252 has been placed over the loaf 252 and insert 220, the bag is then tied in a tying machine (not shown; see, e.g., tying machine 70 in FIGS. 6–9). It is noted that the embodiment just described can also be used in conjunction with the various features that have been described previously with regard to the other embodiments. For example, the present embodiment of the invention can be configured to include multiple insert card conveyors (or a carousel and magazine assembly) to carry a plurality of inserts, as well as a sensor, such as a UPC bar code reader, to help in selecting the proper insert for each wrapper.

Figure 15:
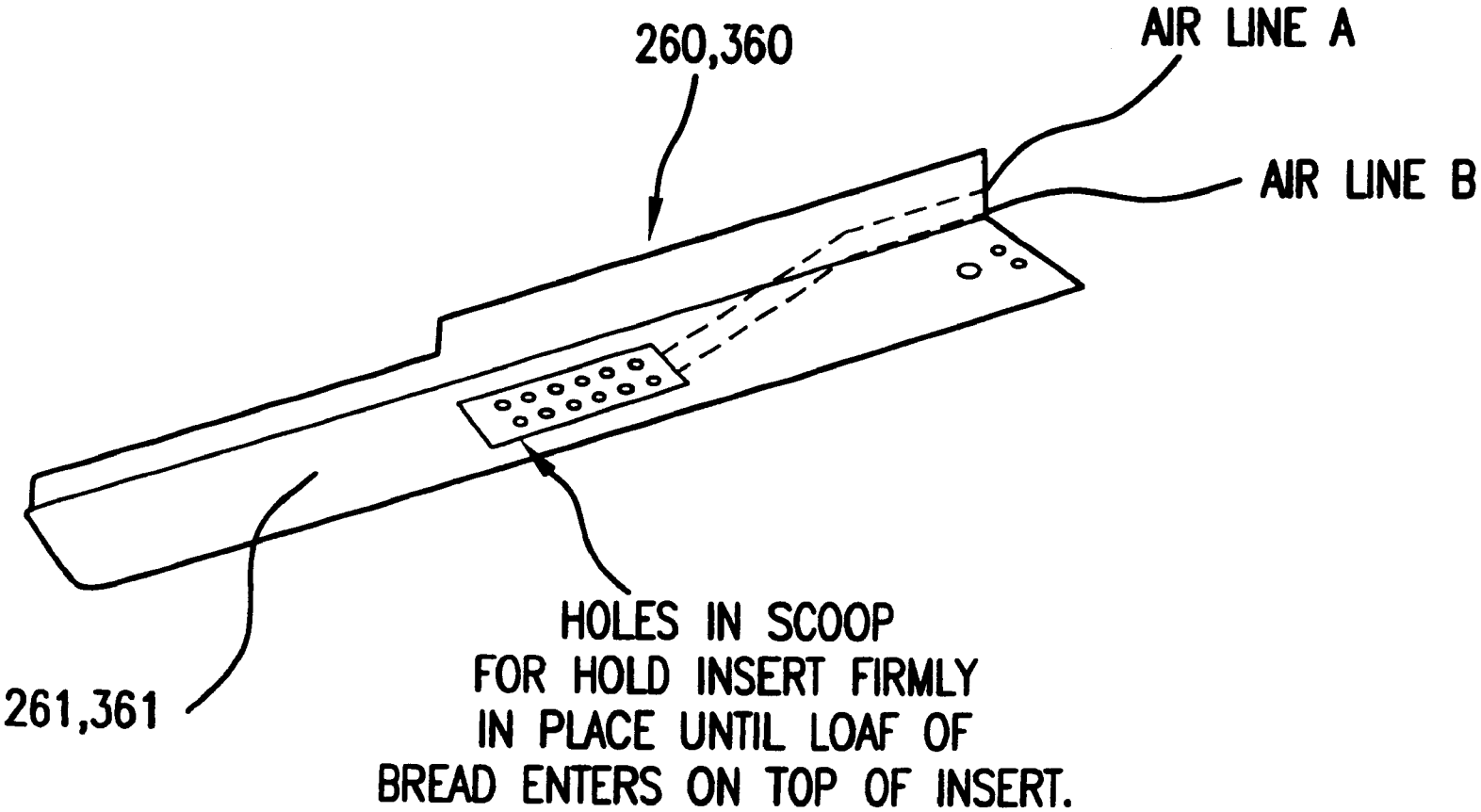
FIG. 15 is a schematic view of the lower bread scoop of the embodiment shown in FIG. 13.

The lower bread scoop 260 is similar to the lower member 60 of the scoop 56 depicted, e.g., in FIG. 6. As shown in FIG. 15, in order to keep the insert 220 stationary on the lower bread scoop 260, a horizontal surface 261, 361 of the scoop 260, 360 of the instant invention contains two sets of air apertures A and B. In a preferred embodiment, each set of apertures is aligned in a straight line, and the two lines are arranged parallel to each other. However, the apertures in each set, as well as the sets themselves, can be arranged in any configuration in order to accommodate the physical and functional requirements for practicing the invention.

An air-jet and vacuum chamber (not shown) is located adjacent the horizontal surface 261, 361 of the lower bread scoop 260, 360. The two sets of air apertures A, B are in turn connected to the air-jet and vacuum chamber via respective air lines (not shown) by conventional means.

Once the insert 220 has been fed, or advanced, onto the lower bread scoop 260 (i.e., once the lower bread scoop 260 has been loaded), suction is applied through the vacuum chamber and the air apertures A and/or A and B in order to securely retain the insert in place before the lower bread scoop 260, 360 receives a loaf of bread 222. The insert 220 and the loaf 222 are then advanced towards the wrapper 252 as described above.

As the scoop assembly begins to move rearwardly, i.e., away from the wrappers 252, the suction effected by the vacuum through air apertures A is terminated. At the same time, the air line connecting the air-jet chamber to air apertures B and/or A and B is activated (e.g., via an on/off toggle switch) to provide blow-off air through the horizontal surface 261, 361 of the lower bread scoop 260, 360. This helps separate the insert 220 from the horizontal surface 261, 361, so that it can remain positioned under the loaf of bread 222 as the lower bread scoop 260, 360 slides from underneath on its way back to the fully-retracted position (as shown, for example, in FIGS. 6–9, and 13).

As has been discussed previously, the timing and placement of the insert and the loaf are critical to the proper operation of the invented system. For example, for all of the embodiments discussed herein in which a feeder mechanism is used, it has been determined that the feeder mechanism and the scoop assembly must be placed perpendicularly to each other. In other words, the longitudinal axis of the feeder mechanism, defining the direction of movement of the insert on the feeder mechanism, should be perpendicular to the longitudinal axis of the scoop, defining the direction of movement of the scoop. In addition, for each such embodiment, the feeder mechanism should preferably lie within a given range of angles as measured from the horizontal. Thus, for the embodiment of FIG. 13, the front portion of the feeder mechanism 231 should preferably be tilted down at an angle of between 45 degrees and 55 degrees from the horizontal.

Depending on various factors including ease of access, machine location and the vantage point of an operator of the system of the instant invention, it may be advantageous to position the insert delivery system in a location away from a distal portion of the infeed conveyor. Thus, FIGS. 14 and 15 show an alternate embodiment of the invention, wherein the inserts are deposited onto the bread scoop in a retracted position, which subsequently receives the loaf of bread, rather than having the insert deposited onto the infeed conveyor ahead of the bread, or onto the scoop when the latter has already advanced.

More specifically, in this embodiment, the insert delivery system comprises an insert card conveyor 316, and an insert placer 318, which are similar, respectively, to the insert car conveyor 216 and insert placer 218 described previously. In a preferred embodiment, as each insert 320 advances along the insert card conveyor 316, vacuum cups 330 of the insert placer 318 engage and secure the insert 320 and place the insert onto a feeder mechanism 331.

Figure 14:
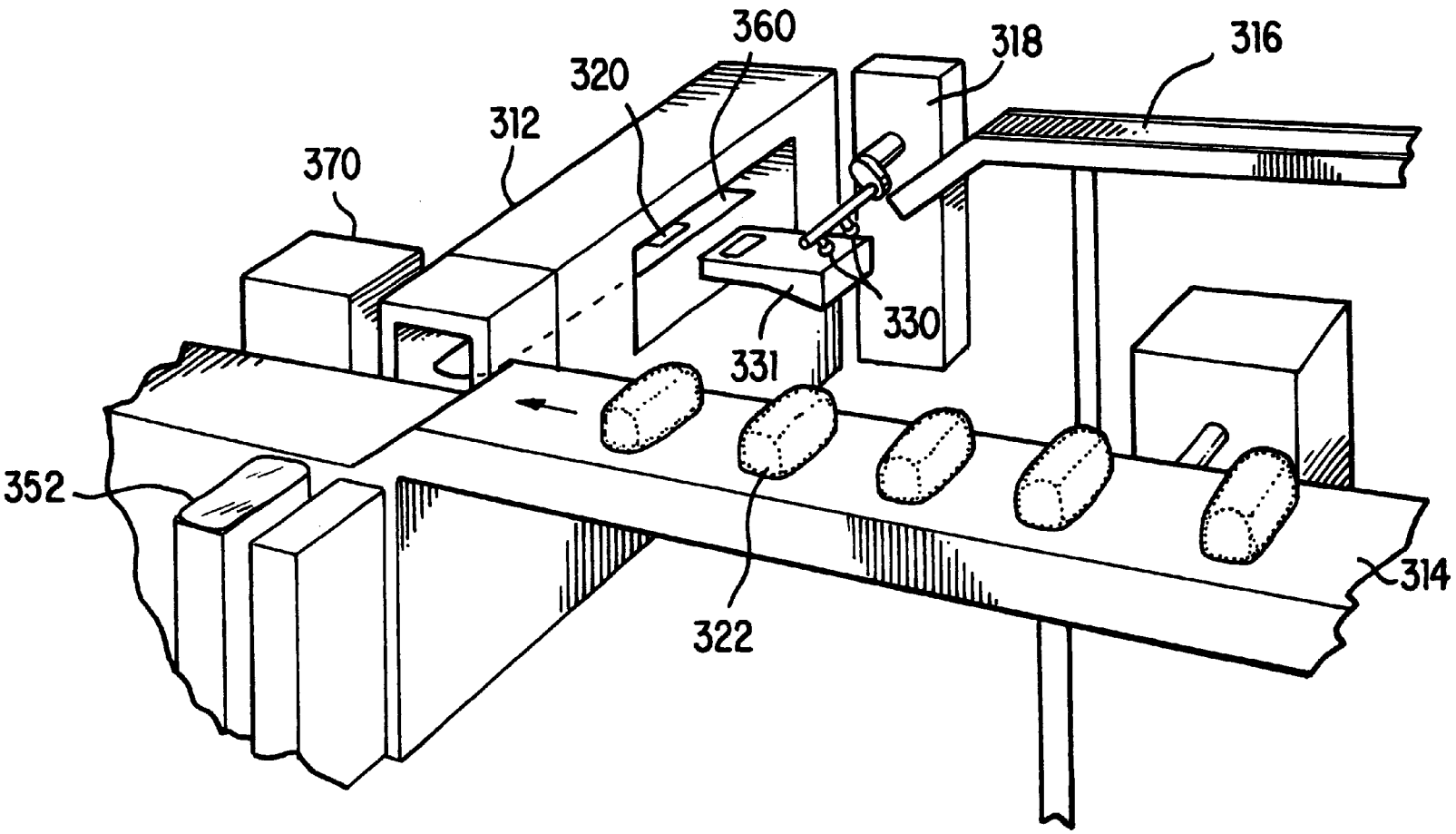
FIG. 14 is a schematic view of an alternative embodiment of the invention.

As shown in FIG. 14, the feeder mechanism 331 is adapted so as to be disposed adjacent a lower bread scoop 360 of the scoop assembly described (and shown, in FIG. 6–9, for example) previously. More specifically, the feeder mechanism, which is a timed advancement mechanism, is positioned such that, when the lower bread scoop 360 is in the retracted position (as shown in FIG. 14), the feeder mechanism 331 receives an insert 320 from the insert placer 318 and, at the appropriate time, feeds, or advances, the insert 320 into the lower bread scoop 360. In a preferred embodiment, the timed deposition of the insert 320 via the feeder mechanism 331 is accomplished in substantially the same manner as that described for the embodiment depicted in FIG. 13. In addition, for the purposes of this embodiment, the front portion of the feeder mechanism 331 should preferably be tilted down at an angle of between 0 degrees (i.e., horizontal and parallel with the ground) and 45 degrees from the horizontal.

The lower bread scoop 360 is similar to the lower member 60 of the scoop 56 depicted, e.g., in FIG. 6. Given that, in this embodiment, the insert 320 is loaded onto the lower bread scoop 360 when the latter is in the retracted position, it must be ensured that the insert 320 remains stationary on the scoop 360 as the scoop extends to receive the loaf of bread 322 on top of the insert 320. Therefore, as shown in FIG. 15, the lower bread scoop 260, 360 of the instant invention has a horizontal surface 261, 361 which contains two sets of air apertures A and B. In a preferred embodiment, each set of apertures is aligned in a straight line, and the two lines are arranged parallel to each other. However, the apertures in each set, as well as the sets themselves, can be arranged in any configuration in order to accommodate the physical and functional requirements for practicing the invention.

An air-jet and vacuum chamber (not shown) is located adjacent the horizontal surface 261, 361 of the lower bread scoop 260, 360. The two sets of air apertures A, B are in turn connected to the air-jet and vacuum chamber via respective air lines (not shown) by conventional means.

Once the insert 320 has been fed, or advanced, onto the lower bread scoop 260, 360 (i.e., once the lower bread scoop 260, 360 has been loaded), suction is applied through the vacuum chamber and first set of air apertures A in order to securely retain the insert in place as the lower bread scoop 260, 360 moves forward (as shown, e.g., in FIG. 7), to receive a loaf of bread 322.

In this embodiment, as in the embodiments described previously, the invention includes an infeed conveyor 314, which is similar in structure and operation to infeed conveyor 14, a packaging machine 312, which is similar to packaging machine 12, and a scoop assembly (not shown), including lower bread scoop 360. As a loaf of bread 322 is advanced on the infeed conveyor 314, a wrapper 352 is opened as described previously (with respect to wrappers 52), and the scoop assembly, including the lower bread scoop 360 that is carrying the insert 320, moves forward toward the wrappers 352 in order to receive the loaf 322. The scoop assembly then continues to advance until its forward portion is inside the wrapper 352. Once inside, the scoop assembly then reverses direction, thus pulling the wrapper 252 over the loaf 322, which then exits the scoop assembly.

As the scoop assembly begins to move rearwardly, i.e., away from the wrappers 352, the suction effected by the vacuum through air apertures A is terminated. At the same time, the air line connecting the air-jet chamber to the second set of air apertures B is activated (e.g., via an on/off toggle switch) to provide blow-off air through the horizontal surface 261, 361 of the lower bread scoop 260, 360. This helps separate the insert 320 from the horizontal surface 261, 361, so that it can remain positioned under the loaf of bread 322 as the lower bread scoop 260, 360 slides from underneath on its way back to the fully-retracted position (as shown, for example, in FIGS. 6–9, and 14).

Once the wrapper 352 has been placed over the loaf 352 and insert 320, the bag is then tied in the tying machine 370.

It is noted that the embodiment just described can also be used in conjunction with the various features that have been described previously with regard to the other embodiments. For example, the present embodiment of the invention can be configured to include multiple insert card conveyors to carry a plurality of inserts, as well as a sensor, such as a UPC bar code reader, to help in selecting the proper insert for each wrapper.

As has been discussed previously, timing and placement are critical to the proper operation of the present invention. Thus, with respect to the embodiments shown in FIGS. 13–15, for example, it is important that the feeder mechanism be positioned, and its insert-advancement mechanism timed, so as to feed the insert onto the scoop in such a way that the insert lands on top of, and covers, all of the vacuum apertures of the scoop. In fact, if the feeder mechanism is not positioned properly, the insert might bounce away from the scoop as it leaves the feeder mechanism. Moreover, mispositioning and/or mistiming of the feeder mechanism may cause the insert to cover less than all of the apertures, which, in turn, would prevent the vacuum system from functioning properly to retain the insert in place. Similarly, the advancement of the scoop should preferably be timed such that the insert is released into the wrapper so as to lie underneath the loaf, between the middle portion and the distal end (i.e., the end that is not twist wrapped) of the loaf.

Figure 16:
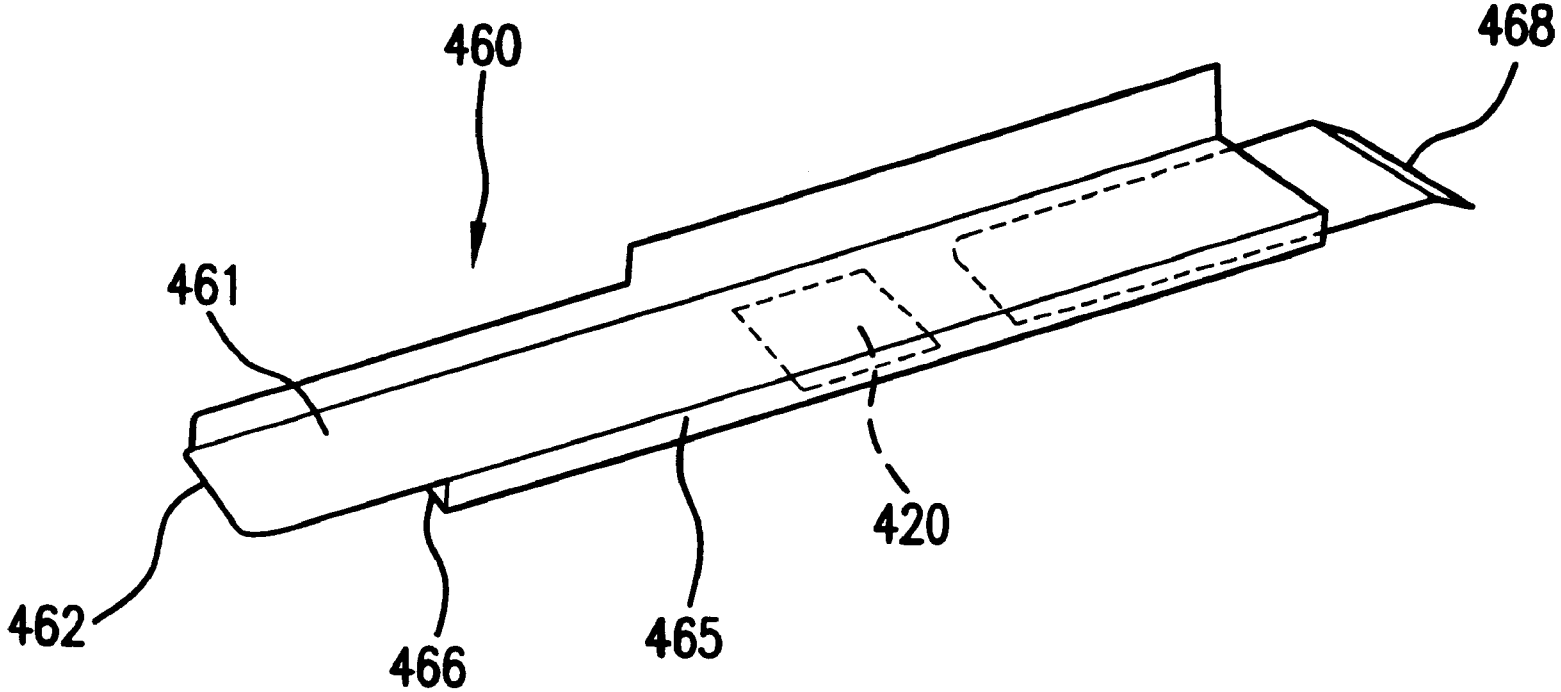
FIG. 16 is a schematic view of a lower bread scoop, modified according to an alternative embodiment of the invention.

In another alternative embodiment, shown in FIG. 16, a bread scoop 460 comprises a horizontal surface 461, as well as a distal end 462. In contrast with the previous embodiment, where an insert 420 would be placed on top of the horizontal surface 461, in the present embodiment, the scoop 460 is equipped with a lower compartment 465, which is disposed underneath the lower surface of the horizontal surface 461 and which receives the insert 420 when the bread scoop 460 is in the retracted position.

Thus, as was described previously with respect to the embodiment depicted in FIGS. 14 and 15, a feeder mechanism (not shown) or similar device may be used to deposit the insert 420 into the lower compartment 465 at the appropriate time, wherein such delivery of the insert into the compartment is timed so as to be coordinated with the movement of loaves of bread on an infeed conveyor (see, e.g., FIG. 14). It is noted that, in this embodiment, the feeder mechanism 431 is preferably located vertically lower (i.e., closer to the ground) than in previous embodiments. In addition, for the purposes of this embodiment, the front portion of the feeder mechanism 431 should preferably be tilted down at an angle of between 0 degrees (i.e., horizontal and parallel with the ground) and 15 degrees from the horizontal.

Once the scoop 460 has been loaded with the insert 420, the scoop 460 advances towards a forward position in order to receive a loaf of bread, and then proceeds to enter a wrapper with its distal end 462, all in the same manner as that described with respect to the embodiment depicted in FIGS. 14 and 15.

As shown in FIG. 16, the lower compartment 465 has a distal end 466 which, in a preferred embodiment, may not extend as far forward as the distal end 462 of the bread scoop 460. Once the distal end 462 of the scoop and the distal end 466 of the lower compartment have fully advanced into the wrapper, a plunger 468, that is slidably coupled to the lower compartment, is moved forward toward the distal end 466 of the lower compartment 465 in order to expel the insert 420 into the wrapper. The scoop assembly then reverses direction, thus depositing the loaf of bread on top of the insert 420 while pulling the wrapper over the loaf. As the scoop assembly begins to move rearwardly, the insert 420 remains positioned under the loaf of bread as the lower compartment and bread scoop slide from underneath on their way back to the fully-retracted position. As before, once the wrapper has been placed over the loaf and insert 420, the wrapper is then tied in a tying machine (not shown).

The plunger 468 is mechanically connected to the bagger, so that synchronization exists between the two components via the PLC. It has been found that, for proper operation of an embodiment of the invention, the release of the insert 420 into the wrapper should be effected within a time window that begins when, as the scoop 460 advances towards the wrapper, the distal end 462 of the scoop 460 is about 3 inches from its fully-extended position, and ends when, on its way back to the retracted position, the distal end 462 of the scoop 460 is again about 3 inches from its fully-extended position. Deposition of the insert 420 into the wrapper within the specified time period helps ensure that the insert 420 will be properly retained in place as the scoop assembly retracts, as well as stay out of the way of the twist wrapping operation of the bagging system.

It is noted that the embodiment just described can also be used in conjunction with the various features that have been described previously with regard to the other embodiments. For example, the present embodiment of the invention can be configured to include multiple insert card conveyors to carry a plurality of inserts, as well as a sensor, such as a UPC bar code reader, to help in selecting the proper insert for each wrapper.

It is also noted that, although in the embodiment that has been shown in FIG. 16, the lower compartment 466 is shorter in length than the bread scoop 460, it is not necessary that this be the case. Moreover, although FIG. 16 shows the use of a plunger 468, it will be apparent to the person skilled in the art that other means for expelling the insert 420 from the lower compartment 465 may also be used. For example, the insert 420 may be expelled by compressed air, or through the use of a pneumatic cylinder or other similar means for urging the insert towards the distal end 466 of the lower compartment 465. Additionally, a vacuum and blow-off air system, similar to those used in the embodiments discussed previously, and shown in FIG. 15, may be used in conjunction with the present embodiment.

The inserts of the invention can comprise a wide variety of items and are not limited to thin, planar objects. Typically, the inserts will be printed material such as coupons, product information sheets, promotional material and the like. However, the insert may also comprise game pieces for contests, sweepstake materials, trading cards, or prizes. The insert may also comprise an envelope having one or more enclosures of the type listed above. Also, the inserts can be product samples such as tea bags, coffee, and dried soup powders contained in suitable pouches. Similarly, in the embodiments of the invention utilizing two- and three-fold inserts, the insert may comprise a perforated or otherwise prefolded card, or may comprise an envelope having a corresponding number of pockets. Oftentimes the size of an insert can be dictated by the Uniform Coupon Council. Currently the preferred size is approximately 3"×6"; other sizes such as 2.5"×8" are also within the scope of the invention.

Although several embodiments have been described herein, one skilled in the art that pertains to the present invention will understand that there are equivalent alternative embodiments. In particular, the embodiments have been described with reference to the delivery of an insert to be automatically packaged with a loaf of bread. However, the invention may also be used with any other similarly-packaged products.

What is claimed is:

1. An insert delivery system comprising:

(a) an insert placer;

(b) a first insert card conveyor configured to present a first insert to the insert placer;

(c) a feeder mechanism, disposed adjacent said insert card conveyor and insert placer, and configured to receive said first insert from said insert placer;

(d) an infeed conveyor to convey a product to be packaged; and (e) a scoop assembly, said scoop assembly being adapted to cycle between a retracted position and a forward position and comprising:

a lower scoop having a horizontal surface configured to receive said product to be packaged; and a lower compartment disposed underneath said horizontal surface to receive said insert, wherein the insert delivery system is configured so that the feeder mechanism delivers the insert onto the scoop assembly when the scoop assembly is in the retracted position.

2. The insert delivery system of claim 1, wherein said lower compartment further includes a plunger, said plunger being slidably coupled to the lower compartment and adapted to urge said insert out of a distal end of said lower compartment.

3. The insert delivery system of claim 1, wherein the insert delivery system further includes means for providing a suction vacuum and an air-jet flow, said horizontal surface of the lower scoop contains a plurality of transverse apertures, and the apertures are in flow communication with said means for providing a suction vacuum and an air-jet flow.

4. The insert delivery system of claim 1, further comprising a plurality of insert card conveyors.

5. The insert delivery system of claim 1, further comprising a programmable logic controller (PLC), an encoder, an infeed sensor positioned along said infeed conveyor, and at least one position sensor connected to the scoop assembly, wherein:

the infeed conveyor and the scoop assembly are configured to run on a single chain cycle;

the PLC is configured to control the operation of the insert delivery system;

the encoder is configured to communicate with the PLC to synchronize the respective speeds of said infeed conveyor and scoop assembly;

the infeed sensor is configured to detect and communicate the presence of said product to the PLC; and the at least one position sensor is in electronic communication with the PLC.

6. The insert delivery system of claim 1, wherein the feeder mechanism and the scoop assembly are disposed such that their respective longitudinal axes are perpendicular to each other, and the front portion of the feeder mechanism is tilted down at an angle of between 0 degrees and 15 degrees from the horizontal.

7. A scoop assembly for receiving and delivering an insert and a product to be packaged, said scoop assembly comprising:

(a) a lower scoop having a horizontal surface configured to receive said product to be packaged; and (b) a lower compartment disposed underneath said horizontal surface to receive said insert, wherein the scoop assembly is adapted to cycle between a retracted position and a forward position and is configured to receive the insert when the scoop assembly is in the retracted position.

8. The scoop assembly of claim 7, wherein said lower compartment includes a plunger, said plunger being slidably coupled to the lower compartment and adapted to urge said insert out of a distal end of said lower compartment.

9. The scoop assembly of claim 7, wherein said product is a loaf of bread.

* * * * *